US006890610B2

(12) United States Patent
Bringley et al.

(10) Patent No.: US 6,890,610 B2
(45) Date of Patent: May 10, 2005

(54) INKJET RECORDING ELEMENT

(75) Inventors: Joseph F. Bringley, Rochester, NY (US); Krishnamohan Sharma, Santa Clara, CA (US); Gary N. Barber, Penfield, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/622,234

(22) Filed: Jul. 18, 2003

(65) Prior Publication Data

US 2005/0013946 A1 Jan. 20, 2005

(51) Int. Cl.[7] ..... B41M 5/40

(52) U.S. Cl. ..... 428/32.36; 428/32.28; 428/32.3; 428/32.37

(58) Field of Search ..... 428/32.28, 32.3, 428/32.36, 32.37

(56) References Cited

U.S. PATENT DOCUMENTS

| | | | | | |
|---|---|---|---|---|---|
| 5,372,884 | A | * | 12/1994 | Abe et al. | 428/32.36 |
| 6,228,475 | B1 | | 5/2001 | Chu et al. | 428/304.4 |
| 6,447,111 | B1 | * | 9/2002 | Gallo et al. | 347/101 |
| 6,619,797 | B2 | * | 9/2003 | Lawrence et al. | 347/105 |
| 6,632,490 | B2 | * | 10/2003 | Sadasivan et al. | 428/32.36 |
| 6,645,582 | B2 | * | 11/2003 | Sadasivan et al. | 428/32.34 |
| 6,692,123 | B2 | * | 2/2004 | Gallo et al. | 347/105 |
| 2003/0063176 | A1 | | 4/2003 | Gallo et al. | |

FOREIGN PATENT DOCUMENTS

| | | |
|---|---|---|
| EP | 1 184 194 | 3/2002 |

* cited by examiner

*Primary Examiner*—B. Shewareged
(74) *Attorney, Agent, or Firm*—Paul A. Leipold

(57) ABSTRACT

A recording element comprising a support having thereon an image-receiving layer, said recording element containing core-shell particles wherein said core comprises an inorganic or organic particle and said shell comprises an organosilane or a hydrolyzed organosilane derived from a compound having the formula:

$$Si(OR)_aZ_b$$

wherein

R is hydrogen, or a substituted or unsubstituted alkyl group having from 1 to about 20 carbon atoms or a substituted or unsubstituted aryl group having from about 6 to about 20 carbon atoms;

Z is an alkyl group having from 1 to about 20 carbon atoms or aryl group having from about 6 to about 20 carbon atoms, with at least one of said Z's having at least one primary, secondary, tertiary or quaternary nitrogen atom;

a is an integer from 1 to 3; and b is an integer from 1 to 3;

with the proviso that a+b=4; and with the further proviso that the amount of organosilane shell material is such that Ratio R, which is the number of micromoles of organosilane used to shell the core particles to the total core particles' surface area (in $m^2$), is greater than 10.

16 Claims, No Drawings

INKJET RECORDING ELEMENT

FIELD OF THE INVENTION

The present invention relates to an inkjet recording element containing core-shell particles which improve the stability of images applied to the receiver.

BACKGROUND OF THE INVENTION

In a typical inkjet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water and an organic material such as a monohydric alcohol, a polyhydric alcohol or mixtures thereof.

An inkjet recording element typically comprises a support having on at least one surface thereof an ink-receiving or image-receiving layer, and includes those intended for reflection viewing, which have an opaque support, and those intended for viewing by transmitted light, which have a transparent support.

An important characteristic of inkjet recording elements is their need to dry quickly after printing. To this end, porous recording elements have been developed which provide nearly instantaneous drying as long as they have sufficient thickness and pore volume to effectively contain the liquid ink. For example, a porous recording element can be manufactured by coating in which a particulate-containing coating is applied to a support and is dried.

When a porous recording element is printed with dye-based inks, the dye molecules penetrate the coating layers. However, there is a problem with such porous recording elements in that atmospheric gases or other pollutant gases readily penetrate the element and lower the optical density of the printed image causing it to fade.

U.S. Pat. No. 6,228,475 B1 to Chu et al. Claims an inkjet recording element comprising a polymeric binder and colloidal silica, wherein all colloidal silica in said image-recording layer consists of colloidal silica having an attached silane coupling agent. The invention is shown to improve the color density, and the color retention (or image bleed) of the element after it has been immersed in water. There is a problem, however, in that the invention of Chu et al. does not provide inkjet images with good fade resistance. It is the object of the present invention to provide an inkjet recording element that, when printed with dye-based inks, provides good image quality, color retention, fast dry time, and has excellent resistance to atmospheric image fade.

Problem to be Solved

There remains a need for inkjet recording elements that, when printed with dye-based inks, provide good image quality, color retention, fast dry-time, and have excellent resistance to atmospheric image fade.

SUMMARY OF THE INVENTION

It is an object of the invention to provide inkjet recording elements that, when printed with dye-based inks, provide good image quality, color retention, fast dry-time, and have excellent resistance to atmospheric image fade.

These and other objects of the invention are accomplished by a recording element comprising a support having thereon an image-receiving layer, said recording element containing core-shell particles wherein said core comprises an inorganic or organic particle and said shell comprises an organosilane or a hydrolyzed organosilane derived from a compound having the formula:

$$Si(OR)_aZ_b$$

wherein

R is hydrogen, or a substituted or unsubstituted alkyl group having from 1 to about 20 carbon atoms or a substituted or unsubstituted aryl group having from about 6 to about 20 carbon atoms;

Z is an alkyl group having from 1 to about 20 carbon atoms or aryl group having from about 6 to about 20 carbon atoms, with at least one Z having at least one primary, secondary, tertiary or quaternary nitrogen atom;

a is an integer from 1 to 3; and b is an integer from 1 to 3;

with the proviso that a+b=4; and with the further proviso that the amount of organosilane shell material is such that Ratio R, which is the ratio of the number of micromoles if organosilane used to shell particles to the total core particles' surface area (in $m^2$), is greater than 10.

Advantageous Effect of the Invention

The invention provides inkjet recording elements that, when printed with dye-based inks, have good image quality, color retention, fast dry time, and have excellent resistance to atmospheric image fade.

DETAILED DESCRIPTION OF THE INVENTION

Inkjet recording media generally comprise a thin layer of small particles coated with a binder for the particles on a paper or plastic support. The coating may contain one, or multiple, coated layers each with specific functions such as increasing ink absorption rate, providing gloss, and mordanting of the dye. Particles used to prepare inkjet media are typically selected from colloidal metal oxides such as silica and alumina. The size of the colloidal particles may range from about 20 nm to about 5000 nm, depending upon the requirements of the media. Smaller particles tend to give glossy media with slow ink absorption rate, whereas larger particles have high ink absorption but are matte in appearance. To prepare an inkjet recording element, colloidal particles are dispersed in water or solvent together with a polymeric binder. The purpose of the binder is to provide adhesion of the particles onto a support. The dispersion may also contain other materials in smaller quantities such as mordants, surfactants, and coating aids. The dispersion is then coated onto a support and allowed to dry. After drying, the coating may form a smooth porous network of particles having both high porosity and high gloss. An image may then be applied to the element usually via an ink-jet printer. High porosity of the recording element is preferred so that ink uptake is rapid and the dry time is short. High-gloss is preferred to provide a bright and vivid image. It is also desired that the image be resistant to bleed and water stain, and that the image have high fade resistance to environmental gases such as oxygen and ozone.

When a porous recording element is printed with dye-based inks, the dye molecules penetrate the coating layers.

The water dries from the ink leaving behind a dried dye image. The dye is then contained in close proximity to the particulate materials comprising the image receiving layer. Chemical interactions between the particle surfaces and the dye can strongly influence the lifetime of the image, since oxygen and other oxidizing gases may adsorb to the particle surfaces. It is generally believed that oxidation (sometimes referred to as bleaching) of the dye by environmental gases is the cause of image fade. Thus, it is desired to manipulate the chemical properties of the surfaces of colloidal particles such that the oxidation or bleaching process is slowed or even eliminated.

In a preferred embodiment of the invention, the core-shell particles consist of a core particle having a negative charge upon its surface and having thereon a shell. Core particles useful in the invention include silica, zinc oxide, zirconium oxide, titanium dioxide, tin oxide, barium sulfate, aluminum oxide, hydrous alumina, calcium carbonate, organic latexes, polymeric particulates and clay minerals such as montmorillonite. In a preferred embodiment of the invention, the core particles are negatively charged. Negatively charged par tides are preferred because they provide a reactive surface upon which positively charged shelling species can be assembled. One skilled in the art can determine the conditions favorable for inducing a negative charge onto various inorganic or organic particles. In a particularly preferred embodiment of the invention, the core particles consist of silica, such as silica gel, hydrous silica, fumed silica, colloidal silica, etc. Silica based core particles are preferred because they are widely available and low cost.

The average particle size diameter of the core particles may vary from about 20 nm to about 5000 nm. It is preferred that the average particle size diameter be greater than 40 nm; and more preferably between 50 and 300 nm. Particles in this size range are preferred because when coated onto a substrate they may provide image receiving layers with both high porosity and high gloss. It is further preferred that said core particles have a specific surface area between 10 and 200 $m^2/g$. Specific surface areas in this range are preferred because they provide adequate surface upon which to apply surface modification, so as to provide highly stable images.

Shell materials useful in the invention are organosilanes or hydrolysable organosilanes described by the general formula:

$$Si(OR)_aZ_b$$

wherein

R is hydrogen, or a substituted or unsubstituted alkyl group having from 1 to about 20 carbon atoms or a substituted or unsubstituted aryl group having from about 6 to about 20 carbon atoms;

Z is an organic group having from 1 to about 20 carbon atoms or aryl group having from about 6 to about 20 carbon atoms, with at least one Z having at least one primary, secondary, tertiary or quaternary nitrogen atom;

a is an integer from 1 to 3; and b is an integer from 1 to 3;

with the proviso that a+b=4.

It is preferred that the organosilane contain at least one hydrolysable substituent such as a methoxy, ethoxy, propoxy, or butoxy group. The hydrolysable substituent may also be an inorganic group such as Cl, Br or I, which is converted to a compound of the above formula when organosilane is placed in water. The hydrolysable substituent attaches the organosilane to the core particle surface via a hydrolysis reaction with a silanol group on the surface of the particles. In a preferred embodiment of the invention, the organosilane contains at least one non-hydrolysable substituent having at least one nitrogen atom. In a particularly preferred embodiment of the invention, the nitrogen atom is an atom in a primary, secondary or tertiary amine or amide, or ureido group. Organosilanes and hydrolysable organosilanes useful for the invention include, 3-aminopropyltrimethoxysilane, 3-aminopropyltriethoxysilane, 3-aminopropyldimethylmethoxysilane, N-(2-aminoethyl)-3-aminopropylmethyldimethoxysilane, 1,4-bis[3-(trimethoxysilyl)propyl]ethylenediamine, bis(2-hydroxyethyl)-3-aminopropyltriethoxysilane, 3-ureidopropyltrimethoxysilane, (N,N-diethyl-3-aminopropyl)trimethoxysilane, N-trimethoxysilylpropyl-N,N,N-tri-n-butylammonium chloride, octadecyldimethyl (3-trimethoxysilylpropyl) ammonium chloride, N-trimethoxysilylpropyl-N,N,N-trimethylammonium chloride, and N-(trimethoxysilylethyl)benzyl-N,N,N-trimethylammonium chloride. These organosilanes are preferred because when coated in image receiving layers made with core-shell particles comprising such organosilanes provide images with high fade resistance.

In a particularly preferred embodiment of the invention, the amount of organosilane or hydrolysable organosilane shell material is in excess of that required to substantially modify all core particle surfaces. This is preferred because it provides the greatest image stability. The amount required to substantially modify all core particle surfaces will vary depending upon the size and surface area of the core particles and upon the size and molecular weight of the organosilane shell material. A measure of the shell coverage of the core particles is given by Ratio R, which is the ratio of the number of micromoles of organosilane used to shell the core particles to the total core particles' surface area (in $m^2$). As Ratio R increases, a greater portion of the core particles' surfaces are covered by the shelling material. It is preferred that Ratio R, which is the ratio of the number of micromoles of organosilane used to shell the core particles to the total core particles' surface area (in $m^2$) is greater than 10 and more preferably greater than 25.

In a preferred embodiment the core-shell particles have a positive electrostatic charge. This is preferred because most inkjet imaging dyes are negatively charged and therefore will be electrostatically attracted to the core-shell particles. The surface charge on the core-shell particles may be adjusted by the addition of acids or bases to aqueous dispersions containing said core-shell particles. The addition of bases tends to lower the positive charge on the surface and the addition of acid tends to increase the density of positive charge on the surface. It is therefore preferred that the pH of aqueous dispersions of said core-shell particles be below about pH 8.5 and more preferably be below about pH 5.0. Acids suitable for adjusting the pH1 of the dispersion may be inorganic or organic acids and include hydrochloric acid, nitric acid, sulfuric acid, hydrobromic acid, acetic acid and other common acids.

In the practice of the invention, core-shell particles are mixed with a polymeric binder and other materials such as mordants, surfactants, etc., and coated onto a support to form an image-receiving layer. It is desired that the image image-receiving layer is porous and also contains a polymeric binder in a small amount insufficient to significantly alter the porosity of the porous image receiving layer. Polymers suitable for the practice of the invention are hydrophilic polymers such as poly(vinyl alcohol), poly (vinyl pyrrolidone), gelatin, cellulose ethers, poly (oxazolines), poly(vinylacetamides), partially hydrolyzed poly(vinyl acetate/vinyl alcohol), poly(acrylic acid), poly (acrylamide), poly(alkylene oxide), sulfonated or phosphated polyesters and polystyrenes, casein, zein, albumin, chitin, chitosan, dextran, pectin, collagen derivatives, collodian, agar—agar, arrowroot, guar, carrageenan, tragacanth, xanthan, rhamsan and the like. In a preferred embodiment of the invention, the hydrophilic polymer is poly(vinyl alcohol), hydroxypropyl cellulose, hydroxypropyl methyl cellulose, or a poly(alkylene oxide). These polymeric binders are preferred because they are readily available and inexpensive.

In addition to the image-receiving layer, the recording element may also contain a base layer between the support and the image receiving layer, the function of which is to absorb the solvent from the ink. Materials useful for this layer include dispersed organic and inorganic microparticles, polymeric binder and/or crosslinker.

The support for the inkjet recording element used in the invention can be any of those usually used for inkjet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), and OPPalyte® films (Mobil Chemical Co.) and other composite films listed in U.S. Pat. No. 5,244,861. Opaque supports include plain paper, coated paper, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In a preferred embodiment, polyethylene-coated paper is employed. Polyethylene-coated paper is preferred because of its high smoothness and quality.

The support used in the invention may have a thickness of from about 50 to about 500 $\mu$m, preferably from about 75 to 300 $\mu$m. This thickness range is preferred because such supports have good structural integrity and are also highly flexible. Antioxidants, antistatic agents, plasticizers and other known additives may be incorporated into the support, if desired.

In order to improve the adhesion of the receiving layer to the support, the surface of the support may be subjected to a corona-discharge treatment prior to applying the image-receiving layer.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure No. 308119, published December 1989, pages 1007 to 1008. Slide coating is preferred, in which the base layers and overcoat may be simultaneously applied. Slide coating is preferred because very high quality coatings may be obtained at a low cost using this method. After coating, the layers are generally dried by simple evaporation, which may be accelerated by known techniques such as convection heating.

In order to impart mechanical durability to an inkjet recording element, crosslinkers which act upon the binder discussed above may be added in small quantities. Such an additive improves the cohesive strength of the layer. Crosslinkers such as 1,4-dioxane 2,3-diol, borax, boric acid, and its salts, carbodiimides, polyfunctional aziridines, aldehydes, isocyanates, epoxides, polyvalent metal cations, and the like may all be used.

To improve colorant fade, UV absorbers, radical quenchers or antioxidants may also be added to the image-receiving layer as is well known in the art. Other additives include inorganic or organic particles, pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01% to 0.30% active coating aid based on the total solution weight. These coating aids can be nonionic, anionic, cationic or amphoteric. Specific elements are described in MCCUTCHEON's Volume 1: Emulsifiers and Detergents, 1995, North American Edition.

The image-receiving layer employed in the invention can contain one or more mordanting species or polymers. The mordant polymer can be a soluble polymer, a charged molecule, or a crosslinked dispersed microparticle. The mordant can be nonionic, cationic or anionic.

The coating composition can be coated either from water or organic solvents; however water is preferred. The total solids content should be selected to yield a useful coating thickness in the most economical way, and for particulate coating formulations, solids contents from 10%–40% are typical.

Inkjet inks used to image the recording elements of the present invention are well-known in the art. The ink compositions used in inkjet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for inkjet printers, they also can be used as recording media for pen plotter assemblies. Pen plotters operate by writing directly on the surface of a recording medium using a pen consisting of a bundle of capillary tubes in contact with an ink reservoir.

While the invention is primarily directed to inkjet printing, the recording element could find use in other imaging areas. Other imaging areas include thermal dye transfer printing, lithographic printing, dye sublimation printing, and xerography.

The following examples are provided to illustrate the invention.

EXAMPLES

Example 1

Dye Stability Evaluation Tests

The dye used for testing was the sodium salt of a magenta colored inkjet dye having the structure shown below. To assess dye stability on a given substrate, a measured amount of the inkjet dye and solid particulates or aqueous colloidal dispersions of solid particulates (typically about 10%–20% solids by weight) were added to a known amount of water such that the concentration of the dye was about $10^{-5}$ M and the concentration of the solid particulates was about 5%. The dispersions containing these dyes were carefully stirred and then spin coated onto a glass substrate at a speed of 1000–2000 rev/min. The spin coatings obtained were left in an ambient atmosphere with fluorescent room lighting (about 0.5 klux) kept on at all times during the test. The fade time was estimated by noting the time required for substantially complete disappearance of magenta color as observed by the naked eye. Starting from an initial optical density of about 1.0, this generally corresponds to the time it takes for the optical density to drop to less than about 3% of the original value.

Magenta Dye

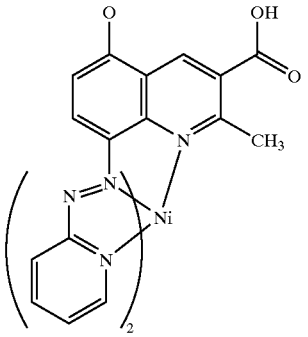

Measurement of Particle Size

The volume-weighted median particle sizes of the particles in the silica and core-shell dispersions were measured by a dynamic light scattering method using a MICROTRAC® Ultrafine Particle Analyzer (UPA) Model 150 from Leeds & Northrop. The analysis provides percentile data that show the percentage of the volume of the particles that is smaller than the indicated size. The 50 percentile is known as the median diameter, which is referred herein as median particle size.

Inventive and Comparative Coatings

Colloidal dispersions of silica particles were obtained from ONDEO Nalco Chemical Company. NALCO® 1115 had a median particle size of 4 nm, a pH of 10.5, a specific gravity of 1.10 g/ml, a surface area of 750 $m^2$/g, and a solids content of 15 weight %. NALCO® 1140 had a median particle size of 15 nm, a pH of 9.7, a specific gravity of 1.29 g/ml, a surface area of 200 $m^2$/g, and a solids content of 40 weight %. NALCO® 1060 had a median particle size of 60 nm, a pH of 8.5, a specific gravity of 1.39 g/ml, a surface area of 50 $m^2$/g, and a solids content of 50 weight %. NALCO® 2329 had a median particle size of 75 nm, a pH of about 9.5, a specific gravity of 1.29 g/ml, a surface area of 40 $m^2$/g, and a solids content of 40 weight %. Two substantially identical samples of NALCO® TX11005 were used; both samples had a median particle size of about 110 nm, a pH of about 9.5, and a surface area of about 26 $m^2$/g. One sample had a solids content of 30.6 weight % and the other had a solids content of 41 weight %.

The hydrolyzable organosilanes examined in this work are represented by the following general formula:

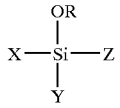

The specific hydrolysable organosilanes used were obtained from Gelest, Inc. and are as follows:

Silane-1 (3-aminopropyltrimethoxysilane): R=Me, X=Y=OMe, Z=$CH_2CH_2CH_2NH_2$

Silane-2 (3-aminopropyltriethoxysilane): R=Et, X=Y=OEt, Z=$CH_2CH_2CH_2NH_2$

Silane-3 (3-ureidopropyltrimethoxysilane; 97 weight %): R=Me, X=Y=OMe, Z=$(CH_2)_3NHCONH_2$ Silane-4 (N-(2-aminoethyl)-3-aminopropylmethyldimethoxysilane; 95 weight %): R=Y=Me, X=OMe, Z=$(CH_2)_3NH(CH_2)_2NH_2$ C-1. To 66.7 g of NALCO® 1115 (15% solids) was added 0.83 g (3.7 mmoles) of Silane-2 and the mixture was vigorously shaken. To this was then added 0.32 ml of glacial acetic acid, and again the contents were vigorously shaken. The resulting dispersion was a viscous liquid, which contained a weight ratio of silica to Silane-2 of 12.0. The dispersion was then coated and tested as described above, and the results are shown in Table 1 below.

C-2. Dispersion C-2 was prepared in an identical manner to that of C-1 except that 1.65 g (7.5 mmoles) of Silane-2 and 0.68 ml of glacial acetic acid were used to make the core-shell dispersion. This dispersion was a viscous liquid, which contained a weight ratio of silica to Silane-2 of 6.0. The dispersion was then coated and tested as described above, and the results are shown in Table 1 below.

C-3. Dispersion C-3 was prepared in an identical manner to that of C-1 except that 3.29 g (14.9 mmoles) of Silane-2 and 1.29 ml of glacial acetic acid were used to make the core-shell dispersion. This dispersion was a viscous liquid, which contained a weight ratio of silica to Silane-2 of 3.0. The dispersion was then coated and tested as described above, and the results are shown in Table 1 below.

C-4. To 25.0 g of NALCO® 1140 (40% solids) was added 0.83 g (3.7 mmoles) of Silane-2 and the mixture was vigorously shaken. To this was then added 0.32 ml of glacial acetic acid, and again the mixture was vigorously shaken. The resulting dispersion was a viscous liquid, which contained a weight ratio of silica to Silane-2 of 12.0. The dispersion was then coated and tested as described above, and the results are shown in Table 1 below.

C-5. Dispersion C-5 was prepared in an identical manner to that of C-4 except that 1.65 g (7.5 mmoles) of Silane-2 and 0.68 ml of glacial acetic acid were used to make the core-shell dispersion. This dispersion was a viscous liquid, which contained a weight ratio of silica to Silane-2 of 6.0. The dispersion was then coated and tested as described above, and the results are shown in Table 1 below.

C-6. Dispersion C-6 was prepared in an identical manner to that of C-4 except that 3.29 g (14.9 mmoles) of Silane-2 and 1.29 ml of glacial acetic acid were used to make the core-shell dispersion. This dispersion was a viscous liquid, which contained a weight ratio of silica to Silane-2 of 3.0. The dispersion was then coated and tested as described above, and the results are shown in Table 1 below.

C-7. To 20.0 g of NALCO® 1060 (50% solids) was added 20.0 g distilled water and 0.83 g (3.7 mmoles) of Silane-2 and the mixture was vigorously shake n. To this was then added 0.32 ml of glacial acetic acid, and again the mixture was vigorously shaken. The resulting dispersion was a nonviscous colloidal dispersion, which contained a weight ratio of silica to Silane-2 of 12.0. The dispersion was then coated and tested as described above, and the results are shown in Table 1 below.

I-1. Dispersion I-1 was prepared in an identical manner to that of C-7 except that 1.65 g (7.5 mmoles) of Silane-2 and 0.68 ml of glacial acetic acid were used to modify the surface charge of the colloidal silica from negative to positive through core-shell particle formation. This dispersion was a nonviscous colloidal dispersion, which contained a weight ratio of silica to Silane-2 of 6.0. The dispersion was then coated and tested as described above, and the results are shown in Table 1 below.

I-2. Dispersion I-2 was prepared in an identical manner to that of C-7 except that 3.29 g (14.9 mmoles) of Silane-2 and 1.29 ml of glacial acetic acid were used to modify the surface charge of the colloidal silica from negative to positive through core-shell particle formation. This dispersion was a nonviscous colloidal dispersion, which contained a weight ratio of silica to Silane-2 of 3.0. The dispersion was then coated and tested as described above, and the results are shown in Table 1 below.

I-3. To 24.4 g of NALCO® TX11005 (41% solids) was added 0.83 g (3.7 mmoles) of Silane-2 and the mixture was vigorously shaken. To this was then added 0.32 ml of glacial acetic acid, and again the mixture was vigorously shaken. In this manner, the surface charge of the colloidal silica was modified from negative to positive through core-shell particle formation. The resulting dispersion was a nonviscous colloidal dispersion, which contained a weight ratio of silica to Silane-2 of 12.0. The dispersion was then coated and tested as described above, and the results are shown in Table 1 below.

I-4. Dispersion I-4 was prepared in an identical manner to that of 1–3 except that 1.65 g (7.5 mmoles) of Silane-2 and 0.68 ml of glacial acetic acid were used to modify the surface charge of the colloidal silica from negative to positive through core-shell particle formation. The resulting dispersion was a nonviscous colloidal dispersion, which contained a weight ratio of silica to Silane-2 of 6.0. The dispersion was then coated and tested as described above, and the results are shown in Table 1 below.

I-5. Dispersion I-5 was prepared in an identical manner to that of 1-3 except that 3.29 g (14.9 mmoles) of Silane-2 and 1.29 ml of glacial acetic acid were used to modify the surface charge of the colloidal silica from negative to positive through core-shell particle formation. The resulting dispersion was a nonviscous colloidal dispersion, which contained a weight ratio of silica to Silane-2 of 3.0. The resulting dispersion was then coated and tested as described above, and the results are shown in Table 1 below.

I-6. An amount of 0.526 g (2.5 mmoles) of Silane-4 was hydrolyzed by the addition of 0.291 g of glacial acetic acid. The hydrolyzed Silane-4 was added to 5.0 g of colloidal silica (NALCO®TX11005; 30.6% solids) to modify the surface charge of the colloidal silica from negative to positive through core-shell particle formation. The resulting dispersion was a nonviscous colloidal dispersion, which contained a weight ratio of silica to Silane-4 of 2.9. The dispersion was then coated and tested as described above, and the results are shown in Table 1 below.

I-7. An amount of 1.053 g (5.0 mmoles) of Silane-4 was hydrolyzed by the addition of 0.582 g of glacial acetic acid. The hydrolyzed Silane-4 was added to 5.0 g of colloidal silica (NALCO® TX11005, 30.6% solids) to modify the surface charge of the colloidal silica from negative to positive through core-shell particle formation. The resulting dispersion was a nonviscous colloidal dispersion, which contained a weight ratio of silica to Silane-4 of 1.5. The dispersion was then coated and tested as described above, and the results are shown in Table 1 below.

I-8. An amount of 0.515 g (2.2 mmoles) of Silane-3 was hydrolyzed by the addition of 0.270 g of glacial acetic acid. The hydrolyzed Silane-3 was added to 5.0 g of colloidal silica (NALCO® TX11005; 30.6% solids) to modify the surface charge of the colloidal silica from negative to positive through core-shell particle formation. The resulting dispersion was a nonviscous colloidal dispersion, which contained a weight ratio of silica to Silane-3 of 2.9. The dispersion was then coated and tested as described above, and the results are shown in Table 1 below.

I-9. An amount of 1.031 g (4.5 mmoles) of Silane-3 was hydrolyzed by the addition of 0.540 g of glacial acetic acid. The hydrolyzed Silane-3 was added to 5.0 g of colloidal silica (NALCO® TX11005; 30.6% solids) to modify the surface charge of the colloidal silica from negative to positive through core-shell particle formation. The resulting dispersion was a nonviscous colloidal dispersion, which contained a weight ratio of silica to Silane-3 of 1.5. The dispersion was then coated and tested as described above, and the results are shown in Table 1 below.

For all inventive and comparative coatings, the ratio, R, was used to relate the number of micromoles of organosilane used to shell the core particles to the total surface area of the core particles. It was calculated as follows:

R=micromoles of organosilane used to shell the core particles/total surface area of core particles where micromoles of organosilane used to shell the core particles= weight (g) of organosilane/molecular weight of organosilane$\times 10^6$ and where total surface area of core particles=weight (g) of core particles×specific surface area ($m^2/g$) of the core particles. The R values calculated in this manner have units of $\mu$moles/$m^2$ and are directly proportional to the extent of surface coverage of the core particles by the organosilane surface modifying agent.

TABLE 1

| Coating | Silica Core Particle Size (nm) | Core-Shell Weight Ratio | Specific Surface Area of Core Particles ($m^2/g$) | R ($\mu$moles/$m^2$) | Fade Time (days) |
|---|---|---|---|---|---|
| C-1 | 4 | 12.0 | 750 | 0.5 | 1 |
| C-2 | 4 | 6.0 | 750 | 1.0 | 1 |
| C-3 | 4 | 3.0 | 750 | 2.0 | 3 |
| C-4 | 15 | 12.0 | 200 | 1.9 | 3 |
| C-5 | 15 | 6.0 | 200 | 3.7 | 3 |
| C-6 | 15 | 3.0 | 200 | 7.4 | 4 |
| C-7 | 60 | 12.0 | 50 | 7.5 | 5 |
| I-1 | 60 | 6.0 | 50 | 15 | 11 |
| I-2 | 60 | 3.0 | 50 | 30 | >25 |
| I-3 | 110 | 12.0 | 26 | 14 | >25 |
| I-4 | 110 | 6.0 | 26 | 29 | >25 |
| I-5 | 110 | 3.0 | 26 | 58 | >25 |
| I-6 | 110 | 2.9 | 26 | 63 | >25 |

TABLE 1-continued

| Coating | Silica Core Particle Size (nm) | Core-Shell Weight Ratio | Specific Surface Area of Core Particles ($m^2/g$) | R ($\mu$moles/$m^2$) | Fade Time (days) |
|---|---|---|---|---|---|
| I-7 | 110 | 1.5 | 26 | 125 | >25 |
| I-8 | 110 | 2.9 | 26 | 55 | 11 |
| I-9 | 110 | 1.5 | 26 | 110 | >25 |

It is apparent from the data in Table 1 that the effectiveness of the organosilane surface modifying agent in improving the fade time (longer times indicate greater stability) is dependent upon a number of factors, including the median particle size diameter of the core particle and the value of Ratio R. Fade time is improved as the median particle size diameter of the core particles is increased and as the total specific surface area of the core particle is decreased. Fade time is also improved as the value of Ratio R is increased, which indicates that improved fade times result only when a considerable excess of organosilane surface modifying agent is used so that substantially all of the surface area of the core particles is covered by the organosilane surface modifying agent. All of the Invention Coatings contained core-shell particles having a relatively high (>10) R value while all of the Comparative Coatings contained core-shell particles having a relatively low (<10) Ratio R value. The data further show that fade time was not dependent on core-shell weight ratio.

Example 2

Element 1 (Invention)

An organosilane modified core-shell dispersion was prepared as follows: To a 200.0 g of NALCO® 2329 (40% solids), 40.0 g of a 1:1 mole ratio mixture of Silane-1 and glacial acetic acid were added very slowly while vigorously stirring the mixture. The core-shell particles in this dispersion had an R value of 52. An aqueous coating formulation was prepared using this dispersion by adding deionized lime-processed gelatin, a gelatin hardener bis(vinyl)sulfonyl methane, and surfactant Zonyl® FSN (E.I. du Pont de Nemours and Co.) to give a coating solution of 25% solids by weight and a core-shell silica/gelatin/gelatin hardener/surfactant ratio of 87.0:10.0:1.4:1.5. A polyethylene-coated paper base, which had been previously subjected to corona discharge treatment, was placed on top of a coating block heated at 40° C. A layer of the coating formulation was coated on the support using a coating blade with a spacing gap of 203 $\mu$m. The coating was then left on the coating block until dry to yield a recording element in which the thickness of the inkjet receiver layer was about 30 $\mu$m and the coverage was about 46 g/$m^2$.

Element 2 (Invention)

Element 2 of the invention was prepared the same as Element 1 except that the organosilane modified core-shell dispersion was made as follows: To a 200.0 g of NALCO® TX11005 (30.6% solids), 36.0 g of a 1:1 mole ratio mixture of Silane-1 and glacial acetic acid were added very slowly while vigorously stirring the mixture. The core-shell particles in this dispersion had an R value of 94.

Element 3 (Invention)

An aqueous coating formulation was prepared by combining the core-shell dispersion (R value of 52) of Element 1, poly(vinyl alcohol) Airvol® 203 (Air Products), and surfactant Zonyl® FSN (E.I. du Pont de Nemours and Co.) to give a coating solution of 24.6% solids by weight and a core-shell silica/poly(vinyl alcohol)/surfactant ratio of 88.3:10.2:1.5. A polyethylene-coated paper base, which had been previously coated with a subbing layer of 720 mg/$m^2$ of a 25/75 mixture of Airvol® 203 poly(vinyl alcohol)/borax, was placed on top of a coating block heated at 40° C. A layer of the coating formulation was coated on the subbed support using a coating blade with a spacing gap of 203 $\mu$m. The coating was then left on the coating block until dry to yield a recording element in which the thickness of the inkjet receiver layer was about 30 $\mu$m and the coverage was about 31 g/$m^2$.

Element 4 (Invention)

Element 4 of the invention was prepared the same as Element 3 except that the organosilane modified core-shell dispersion (R value of 94) of Element 2 was used in place of the core-shell silica dispersion of Element 3.

Element 5 (Comparative)

Comparative Element 5 was prepared the same as Element 1 except that colloidal silica NALCO® 2329 (40% solids) was used in place of the core-shell dispersion of Element 1. The unshelled silica particles in this dispersion had an R value of 0.

Element 6 (Comparative)

Comparative Element 6 was prepared the same as Element 2 except that colloidal silica NALCO® TX11005 (30.6% solids) was used in place of the core-shell dispersion of Element 2. The unshelled silica particles in this dispersion had an R value of 0.

Element 7 (Comparative)

Comparative Element 7 was prepared the same as Element 3 except that colloidal silica NALCO® 2329 (40% solids) was used in place of the core-shell dispersion of Element 3. The unshelled silica particles in this dispersion had an R value of 0.

Element 8 (Comparative)

Comparative Element 8 was prepared the same as Element 4 except that colloidal silica NALCO® TX11005 (30.6% solids) was used in place of the core-shell dispersion of Element 4. The unshelled silica particles in this dispersion had an R value of 0.

Each of the elements was printed using an Epson Stylus® Photo 870 inkjet printer using inks with catalogue numbers C13T007201 and C13T008201. Each ink (cyan, magenta, and yellow) and a process black (a combination of cyan, magenta, and yellow ink) were printed in 6 steps of increasing density, and the optical density of each step was read using a GretagMacbeth™ Spectrolino/SpectroScan. The samples were then placed together in a controlled atmosphere of 5 parts per million ozone concentration, and the densities at each step reread after 6 hours and again after 5 more days (total time of 5.25 days). The percent density loss at a starting density of 1.0 was interpolated for each single dye and for each channel of the process black. The results are summarized in Tables 2 and 3 below.

TABLE 2

Interpolated % Fade from Starting Density of 1.0 in 6 hours

| Element | C | M | Y | C of Process Black | M of Process Black | Y of Process Black |
|---|---|---|---|---|---|---|
| 1 (Inv.) | 1.3 | 3.5 | −1.8 | −0.8 | 1.4 | −1.9 |
| 2 (Inv.) | 1.1 | 1.1 | −0.4 | 0.5 | 0.5 | −0.6 |
| 3 (Inv.) | −0.3 | 2.6 | −0.6 | −1.7 | 0.8 | −1.2 |
| 4 (Inv.) | −0.2 | 2.9 | −0.2 | 2.3 | 3.9 | 2.9 |
| 5 (Comp.) | 10.5 | 8.0 | 0.0 | 11.2 | 9.7 | −0.7 |

TABLE 2-continued

Interpolated % Fade from Starting Density of 1.0 in 6 hours

| Element | C | M | Y | C of Process Black | M of Process Black | Y of Process Black |
|---|---|---|---|---|---|---|
| 6 (Comp.) | 13.4 | 10.6 | 0.7 | 10.9 | 9.5 | 2.0 |
| 7 (Comp.) | 36.4 | 18.0 | 0.1 | 36.5 | 35.1 | 5.1 |
| 8 (Comp.) | 29.9 | 27.2 | 1.1 | 25.1 | 27.1 | 5.2 |

TABLE 3

Interpolated % Fade from Starting Density of 1.0 in 5.25 days

| Element | C | M | Y | C of Process Black | M of Process Black | Y of Process Black |
|---|---|---|---|---|---|---|
| 1 (Inv.) | 5.5 | 9.0 | 0.5 | 1.7 | 3.8 | 1.2 |
| 2 (Inv.) | 2.1 | 1.9 | −1.4 | 3.0 | 2.5 | 0.4 |
| 3 (Inv.) | −2.3 | 2.0 | −7.0 | −2.9 | 2.8 | −2.3 |
| 4 (Inv.) | 0.4 | 5.3 | −11.8 | 1.7 | 5.8 | 0.6 |
| 5 (Comp.) | 29.0 | 42.7 | 11.5 | 34.7 | 48.4 | 18.3 |
| 6 (Comp.) | 33.7 | 47.8 | 11.3 | 28.6 | 36.1 | 18.2 |
| 7 (Comp.) | 75.5 | 77.3 | 6.8 | 79.3 | 72.6 | 24.9 |
| 8 (Comp.) | 59.2 | 91.0 | 9.3 | 45.0 | 49.3 | 16.5 |

It is readily apparent from the data in Tables 2 and 3 that the fade in the cyan, magenta, yellow, and process black channels is less for all of the Invention Elements than for the Comparative Elements. All of the Invention Elements contained core-shell particles having a relatively high (>10) Ratio R value while all of the Comparison Elements contained unshelled particles having a Ratio R value of 0.

Example 3

Element 9 (Invention)

An organosilane modified core-shell dispersion was prepared as follows: To a 400.0 g of NALCO® TX11005 (41% solids), 60.0 g of a 1:2 mole ratio solution of Silane-2 and glacial acetic acid were added very slowly while vigorously stirring the mixture. The core-shell particles in this dispersion had an R value of 42. An aqueous coating formulation of this dispersion was prepared by combining deionized lime-processed gelatin, a gelatin hardener bis(vinyl)sulfonyl methane, and surfactant Zonyl® FSN to give a coating solution of 25% so lids by weight and a core-shell silica/gelatin/gelatin hardener/surfactant ratio of 87.1:10.0:1.4:1.5. A polyethylene-coated paper base, which had been previously subjected to corona discharge treatment, was placed on top of a coating block heated at 40° C. A layer of the coating formulation was coated on the support using a coating blade with a spacing gap of 203 μm. Immediately after the coating formulation was applied, the coating block was cooled to 12° C. After 10 minutes, the coating was removed from the coating block, allowed to stand at ambient temperature for several hours, and finally dried in an oven at 37° C. for 30 minutes to yield a recording element in which the thickness of the inkjet receiver layer was about 28 μm and the coverage was about 31 g/m$^2$.

Element 10 (Invention)

Element 10 of the invention was prepared the same as Element 9 except that the organosilane modified core-shell dispersion was made as follows: To a 400.0 g of NALCO® TX11005 (41% solids), 40.0 g of a 1:2 mole ratio mixture of Silane-2 and glacial acetic acid were added very slowly while vigorously stirring the mixture. The core-shell particles in this dispersion had an R value of 28.

Element 11 (Invention)

An aqueous coating formulation was prepared by combining the organosilane modified core-shell dispersion (R value of 42) described in Element 9, poly(vinyl alcohol) Airvol® 203, and surfactant Zonyl® FSN to give a coating solution of 24.6% solids by weight and a core-shell silica/poly(vinyl alcohol)/surfactant ratio of 88.3:10.2:1.5. A polyethylene-coated paper base, which had been previously coated with a subbing layer of 720 mg/m$^2$ of a 25/75 mixture of Airvol® 203 poly(vinyl alcohol)/borax, was placed on top of a coating block heated at 40° C. A layer of the coating formulation was coated on the subbed support using a coating blade with a spacing gap of 203 μm. The coating was then left on the coating block until dry to yield a recording element in which the thickness of the inkjet receiver layer was about 27 μm and the coverage was about 43 g/m$^2$.

Element 12 (Invention)

Element 12 of the invention was prepared the same as Element 11 except that the core-shell dispersion (R value of 28) described in Element 10 was used in place of the core-shell dispersion of Element 11.

Element 13 (Comparative)

Comparative Element 13 was prepared as Element 9 except that colloidal silica NALCO® TX11005 (41% solids) was used in place of the organosilane modified core-shell dispersion of Element 9. The unshelled particles in this dispersion had an R value of 0.

Element 14 (Comparative)

Comparative Element 14 was prepared as Element 11 except that colloidal silica NALCO® TX11005 (41% solids) was used in place of the organosilane modified core-shell dispersion of Element 11. The unshelled particles in this dispersion had an R value of 0.

Each of the elements was printed using an Epson Stylus® Photo 870 inkjet printer using inks with catalogue numbers C13T007201 and C13T008201. Each ink (cyan, magenta, and yellow) and a process black were printed in 6 steps of increasing density, and the optical density of each step was read using a GretagMacbeth™ Spectrolino/SpectroScan. The samples were then placed together in a controlled atmosphere of 5 parts per million ozone concentration, and the densities at each step reread after 6 hours and again after 3 more days (total time of 3.25 days). The percent density loss at a starting density of 1.0 was interpolated for each single dye and for each channel of the process black. The results are summarized in Tables 4 and 5 below.

TABLE 4

Interpolated % Fade from Starting Density of 1.0 in 6 hours

| Element | C | M | Y | C of Process Black | M of Process Black | Y of Process Black |
|---|---|---|---|---|---|---|
| 9 (Inv.) | −0.4 | 4.4 | 0.0 | −3.2 | 1.9 | 2.5 |
| 10 (Inv.) | 0.2 | −2.5 | 0.0 | −3.4 | −1.8 | −1.8 |
| 11 (Inv.) | 3.2 | −0.5 | −5.2 | 0.9 | 2.1 | −5.1 |
| 12 (Inv.) | −2.8 | 0.5 | −0.9 | −0.8 | 1.6 | −4.9 |
| 13 (Comp.) | 31.0 | 19.9 | 3.4 | 6.0 | 9.2 | 7.1 |
| 14 (Comp.) | 20.1 | 2.2 | 0.4 | 8.8 | 9.2 | 1.7 |

TABLE 5

Interpolated % Fade from Starting Density of 1.0 in 3.25 days

| Element | C | M | Y | C of Process Black | M of Process Black | Y of Process Black |
|---|---|---|---|---|---|---|
| 9 (Inv.) | 0.1 | 4.3 | 1.0 | −2.6 | 3.1 | 3.8 |
| 10 (Inv.) | 2.2 | −2.4 | 2.1 | −1.6 | 0.1 | −1.2 |

TABLE 5-continued

Interpolated % Fade from Starting Density of 1.0 in 3.25 days

| Element | C | M | Y | C of Process Black | M of Process Black | Y of Process Black |
|---|---|---|---|---|---|---|
| 11 (Inv.) | 7.4 | 4.8 | −5.3 | 0.8 | 3.0 | −7.7 |
| 12 (Inv.) | −2.4 | 4.8 | 2.7 | 0.2 | 5.4 | −4.4 |
| 13 (Comp.) | 86.2 | 89.8 | 20.3 | 55.6 | 61.3 | 42.8 |
| 14 (Comp.) | 70.2 | 95.4 | 7.5 | 19.5 | 20.5 | 9.8 |

It is quite evident from the data in Tables 4 and 5 that the fade in the cyan, magenta, yellow, and process black channels is less for the Invention Elements 12 than for the Comparative Elements. All of the Invention Elements contained core-shell particles having a relatively high (>10) Ratio R value while all of the Comparative Elements contained unshelled particles having a Ratio R value of 0.

Although the invention has been described in detail with reference to certain preferred embodiments for the purpose of illustration, it is to be understood that variations and modifications can be made by those skilled in the art without departing from the spirit and scope of the invention.

What is claimed is:

1. A recording element comprising a support having thereon an image-receiving layer, said recording element containing core-shell particles wherein said core comprises an inorganic or organic particle and said shell comprises an organosilane or a hydrolyzed organosilane derived from a compound having the formula:

$$Si(OR)_aZ_b$$

wherein

R is hydrogen, or a substituted or unsubstituted alkyl group having from 1 to about 20 carbon atoms or a substituted or unsubstituted aryl group having from about 6 to about 20 carbon atoms;

Z is an alkyl group having from 1 to about 20 carbon atoms or aryl group having from about 6 to about 20 carbon atoms, with at least one of Z having at least one primary, secondary, tertiary or quaternary nitrogen atom;

a is an integer from 1 to 3; and b is an integer from 1 to 3;

with the proviso that a+b=4; and with the further proviso that the amount of organosilane shell material is such that Ratio R, which is the number of micromoles of organosilane used to shell the core particles to the total core particles' surface area (in $m^2$), is greater than 10.

2. The element of claim 1 wherein said image-receiving layer comprises an inkjet receiving layer.

3. The element of claim 1 in which Ratio R, which is the number of micromoles of organosilane used to shell the core particles to the total core particles' surface area (in $m^2$), is greater than 25.

4. The element of claim 1 wherein said core comprises an inorganic or organic particle having a median particle size diameter greater than 40 nm.

5. The element of claim 1 wherein said core comprises an inorganic or organic particle having a median particle size diameter between 50 and 300 nm.

6. The element of claim 1 wherein said core comprises an inorganic or organic particle having a specific surface area between 10 and 200 $m^2/g$.

7. The element of claim 1 wherein said shell material has at least one substituent comprising a primary, secondary or tertiary amine or amide or ureido group.

8. The element of claim 1 wherein the surfaces of said core-shell particles are positively charge.

9. The recording element of claim 1 wherein said core-shell particles are present in said image-receiving layer.

10. The recording element of claim 1 wherein said core-shell particles are present in an overcoat layer.

11. The recording element of claim 1 wherein Z is an alkyl group having from 1 to about 6 carbon atoms containing one or two primary or secondary amine moieties.

12. The recording element of claim 1 wherein said core comprises silica.

13. The recording element of claim 1 which also includes a base layer located between said image-receiving layer and said support.

14. The recording element of claim 1 wherein said image-receiving layer contains a mordant.

15. The recording element of claim 1 further wherein said image-receiving layer comprising a binder.

16. The recording element of claim 15 wherein said binder comprises polyvinyl alcohol.

* * * * *